US010842231B2

(12) United States Patent
Machini

(10) Patent No.: US 10,842,231 B2
(45) Date of Patent: Nov. 24, 2020

(54) CUFFLINK WITH INTERCHANGEABLE SETTING

(71) Applicant: Joseph Machini, Hollywood, FL (US)

(72) Inventor: Joseph Machini, Hollywood, FL (US)

( * ) Notice: Subject to any disclaimer, the term of this patent is extended or adjusted under 35 U.S.C. 154(b) by 0 days.

(21) Appl. No.: 16/254,431

(22) Filed: Jan. 22, 2019

(65) Prior Publication Data

US 2019/0223558 A1 Jul. 25, 2019

Related U.S. Application Data

(60) Provisional application No. 62/620,387, filed on Jan. 22, 2018.

(51) Int. Cl.

| | |
|---|---|
| ***A44B 5/02*** | (2006.01) |
| ***A44C 17/02*** | (2006.01) |
| ***A44B 5/00*** | (2006.01) |

(52) U.S. Cl.

CPC ..... *A44B 5/02* (2013.01); *A44B 5/002* (2013.01); *A44C 17/0225* (2013.01)

(58) Field of Classification Search

CPC ..... A44B 5/002; A44B 5/02; A44C 17/0225
See application file for complete search history.

(56) References Cited

U.S. PATENT DOCUMENTS

| | | | | |
|---|---|---|---|---|
| 305,137 | A | 9/1884 | Bloomer | |
| 891,161 | A | 6/1908 | Goodwin | |
| 1,121,296 | A | 12/1914 | Schmidt | |
| 1,152,340 | A | 8/1915 | Obsboum | |
| 1,596,642 | A | 8/1926 | Weber | |
| 2,220,408 | A | 11/1940 | Kalina | |
| D203,792 | S | 2/1966 | Mills | |
| 3,538,556 | A * | 11/1970 | Shein | A44B 5/002 24/114.11 |
| 3,933,011 | A | 1/1976 | DiGilio et al. | |
| 4,608,838 | A | 9/1986 | Gardner | |
| 4,742,696 | A | 5/1988 | Jenkins | |
| 4,794,766 | A | 1/1989 | Schunk et al. | |
| 4,905,482 | A | 3/1990 | Gheblikian | |

(Continued)

FOREIGN PATENT DOCUMENTS

| | | | |
|---|---|---|---|
| JP | 2014212890 | A | 11/2014 |
| WO | 2014110501 | A3 | 4/2015 |
| WO | 2019144148 | A1 | 7/2019 |

OTHER PUBLICATIONS

International Preliminary Report on Patentability for International Application PCT/US2014/011281, Report Issued Jul. 14, 2015, dated Jul. 23, 2015, 8 pgs.

(Continued)

*Primary Examiner* — Robert Sandy
*Assistant Examiner* — David M Upchurch
(74) *Attorney, Agent, or Firm* — KPPB LLP

(57) ABSTRACT

A cufflink with interchangeable setting that allows for an ornamental element to be inserted, removed, and replaced is provided. The cufflink with interchangeable setting includes a plurality of elongated shafts, a plurality of holding arms, and a securing mechanism. When the interchangeable setting is in its secured position, the ornamental element is immobilized by the holding arms and cannot be removed. The ornamental element may be removed and replaced when the interchangeable setting is in an open position.

21 Claims, 5 Drawing Sheets

(56) References Cited

U.S. PATENT DOCUMENTS

| | | | | |
|---|---|---|---|---|
| 5,228,317 | A | 7/1993 | Hendricks | |
| 5,253,490 | A | 10/1993 | Doganay | |
| 5,375,434 | A | 12/1994 | Wertheimer et al. | |
| 5,419,158 | A | 5/1995 | Sandberg et al. | |
| 5,456,095 | A | 10/1995 | Tawil et al. | |
| 5,669,241 | A | 9/1997 | Kohl | |
| 6,318,122 | B1 | 11/2001 | Burgard | |
| 6,588,067 | B2 * | 7/2003 | Efron | A44B 5/002 24/102 FC |
| 6,594,871 | B2 * | 7/2003 | Hoffman | A44B 5/00 24/102 R |
| 6,715,315 | B1 | 4/2004 | Hartgrove | |
| 8,661,848 | B2 | 3/2014 | Bisserier | |
| 9,113,681 | B2 | 8/2015 | Machini | |
| 9,282,789 | B1 * | 3/2016 | Lavoie | A44B 5/002 |
| 9,468,269 | B2 | 10/2016 | Machini | |
| 10,070,698 | B1 * | 9/2018 | Stein | A44B 5/002 |
| 10,123,595 | B2 | 11/2018 | Machini | |
| 2002/0178549 | A1 | 12/2002 | Efron et al. | |
| 2004/0177647 | A1 | 9/2004 | Dennis | |
| 2005/0126223 | A1 | 6/2005 | Maschio | |
| 2006/0236509 | A1 * | 10/2006 | Ausman | A44B 5/02 24/303 |
| 2011/0277213 | A1 * | 11/2011 | Stoehr | A44B 5/02 2/123 |
| 2012/0011888 | A1 | 1/2012 | Patterson | |
| 2012/0198887 | A1 | 8/2012 | Bisserier | |
| 2013/0019635 | A1 | 1/2013 | Patterson | |
| 2013/0074547 | A1 | 3/2013 | Nhaissi | |
| 2014/0110501 | A1 | 7/2014 | Lawyer et al. | |
| 2014/0196500 | A1 | 7/2014 | Machini | |
| 2015/0320155 | A1 | 11/2015 | Machini et al. | |
| 2017/0055645 | A1 | 3/2017 | Machini | |

OTHER PUBLICATIONS

International Search Report and Written Opinion for International Application No. PCT/US2014/011281, Search completed Jan. 22, 2015, dated Feb. 2, 2015, 11 pgs.

International Search Report and Written Opinion for International Application No. PCT/US2019/014618, Search completed Feb. 28, 2019, dated Mar. 15, 2019, 7 pgs.

* cited by examiner

CUFFLINK WITH INTERCHANGEABLE SETTING

CROSS REFERENCE TO RELATED APPLICATIONS

This application claims priority to U.S. Provisional Application No. 62/620,387, entitled "Cufflink with Interchangeable Setting" to Machini, filed Jan. 22, 2018, the disclosure of which is incorporated by reference herein in its entirety.

FIELD OF THE INVENTION

The present invention relates generally to an interchangeable jewelry setting, and more specifically to a cufflink wherein an ornamental element displayed by the cufflink may be easily replaced by another ornamental element.

BACKGROUND OF THE INVENTION

Cufflinks are jewelry articles that are used to secure the cuffs of dress shirts and can be manufactured from a variety of different materials. As with most jewelry, cufflinks typically have a permanently-attached ornamental element or design.

Dress shirts come in a wide variety of colors and designs, and it is not practical or economic for people to buy multiple cufflinks with expensive settings in the hopes of having cufflinks with ornamental elements that will complement the wearer's multiple dress shirt options. Additionally, cufflinks must fit in the dress shirt cuffs snugly without excessive movement or causing the wearer any discomfort, meaning the settings should not be excessively bulky, complicated, or heavy.

SUMMARY OF THE INVENTION

The present disclosure provides in accordance with the current invention embodiments of cufflinks with interchangeable settings.

In some embodiments, the invention is directed to a cufflink with interchangeable setting comprising:

- a plurality of elongated shafts, rotatably interconnected about a single axis of rotation at a first end, each shaft being divided into at least two legs at least at a second end thereof;
- a leg connecting part disposed between the legs of each of the shafts proximal to the second end thereof;
- a plurality of holding arms disposed proximal to the first end of the plurality of elongated shafts such that at least one holding arm is disposed on each of the shafts, and such that the holding arms rotate relative to each other when the plurality of elongated shafts are rotated; and
- a securing mechanism, configured to releasably engage the leg connecting parts of the elongated shafts to prevent rotation of the shafts relative to each other;
- wherein the interchangeable setting has a secured position wherein the elongated shafts are disposed parallel, and where the plurality of holding arms are arranged to engage and immobilize an ornamental element therebetween, and an open position wherein the elongated shafts and holding arms are rotated away from each other such that the ornamental element is removable from the interchangeable setting.

In some such embodiments, at least one elongated shaft further comprises at least one mechanical supporting part.

In other such embodiments, the elongated shafts are rotatably interconnected by a hinge or pin.

In still other embodiments, each elongated shaft has two holding arms disposed thereon.

In yet other embodiments, each elongated shaft is divided into two legs at a second end thereof.

In still yet other embodiments, the cufflink with interchangeable setting has two elongated shafts.

In some such embodiments, the securing mechanism is configured to rotate around the leg connecting parts when the securing mechanism engages said leg connecting parts in the secured position, and wherein the securing mechanism has a parallel position where the securing mechanism is disposed parallel to the elongated shafts, and a perpendicular position where the securing mechanism is disposed perpendicular to the elongated shafts.

In other such embodiments, the securing mechanism comprises:

- a plurality of securing arms, where the plurality of securing arms are rotatably interconnected about an axis of rotation;
- at least one groove, where the at least one groove is disposed to engage the leg connecting parts therebetween; and
- a closure, where the closure is configured to releasably engage the securing arms to prevent rotation of the securing arms.

In still other embodiments, each securing arm has one groove disposed thereon.

In yet other embodiments, the securing mechanism has two securing arms.

In still yet other embodiments, the closure is selected from the group consisting of a clasp, latch, snap closure, slot closure, and magnetic closure.

In some such embodiments, the securing arms are rotatably interconnected by a hinge or pin.

In other such embodiments, the leg connecting parts collectively form a cylindrical shape in the secured position.

In still other embodiments, each leg connecting part has a semicircular cross section.

In yet other embodiments, the ornamental element is selected from the group consisting of a loose gem, a set gem, a plurality of gems, a plurality of set gems, a metallic engraving, an ornamental design element, and a button.

In still yet other embodiments, the invention is directed to a cufflink with interchangeable setting comprising:

- two elongated shafts, rotatably interconnected about a single axis of rotation at a first end, each shaft being divided into two legs at least at a second end thereof;
- a leg connecting part disposed between the legs of each of the shafts proximal to the second end thereof;
- a plurality of holding arms disposed proximal to the first end of the two elongated shafts such that two holding arms are disposed on each of the shafts, and such that the holding arms rotate relative to each other when the two elongated shafts are rotated; and
- a securing mechanism, configured to releasably engage the leg connecting parts of the elongated shafts to prevent rotation of the shafts relative to each other, where the securing mechanism comprises:
  - two securing arms, where the securing arms are rotatably interconnected about an axis of rotation;
  - two grooves, where the grooves are disposed to engage the leg connecting parts therebetween, and where each securing arm has one groove disposed thereon; and a closure, where the closure is configured to releasably engage the securing arms to prevent rotation of the securing arms;

wherein the interchangeable setting has a secured position wherein the elongated shafts are disposed parallel, and where the plurality of holding arms are arranged to engage and immobilize an ornamental element therebetween, and an open position wherein the elongated shafts and holding arms are rotated away from each other such that the ornamental element is removable from the interchangeable setting;

wherein the securing mechanism is configured to rotate around the leg connecting parts when the securing mechanism engages said leg connecting parts in the secured position, and wherein the securing mechanism has a parallel position where the securing mechanism is disposed parallel to the elongated shafts, and a perpendicular position wherein the securing mechanism is disposed perpendicular to the elongated shafts; and wherein the leg connecting parts collectively form a cylindrical shape in the secured position, and each leg connecting part has a semicircular cross section.

In some embodiments, at least one elongated shaft further comprises at least one mechanical supporting part.

In some such embodiments, the elongated shafts are rotatably interconnected by a hinge or pin.

In other such embodiments, the closure is selected from the group consisting of a clasp, latch, snap closure, slot closure, and magnetic closure.

In still other embodiments, the ornamental element is selected from the group consisting of a loose gem, a set gem, a plurality of gems, a plurality of set gems, a metallic engraving, an ornamental design element, and a button.

In yet other embodiments, the securing arms are rotatably interconnected by a hinge or pin.

BRIEF DESCRIPTION OF THE DRAWINGS

The description will be more fully understood with reference to the following figures, which are presented as exemplary embodiments of the disclosure and should not be construed as a complete recitation of the scope of the invention, wherein:

FIG. 1A shows the interchangeable setting in an open position where the ornamental element may be inserted, removed, or replaced, and FIG. 1B shows the interchangeable setting in a secured position with the ornamental element immobilized.

DETAILED DESCRIPTION OF THE INVENTION

Figure 1A:
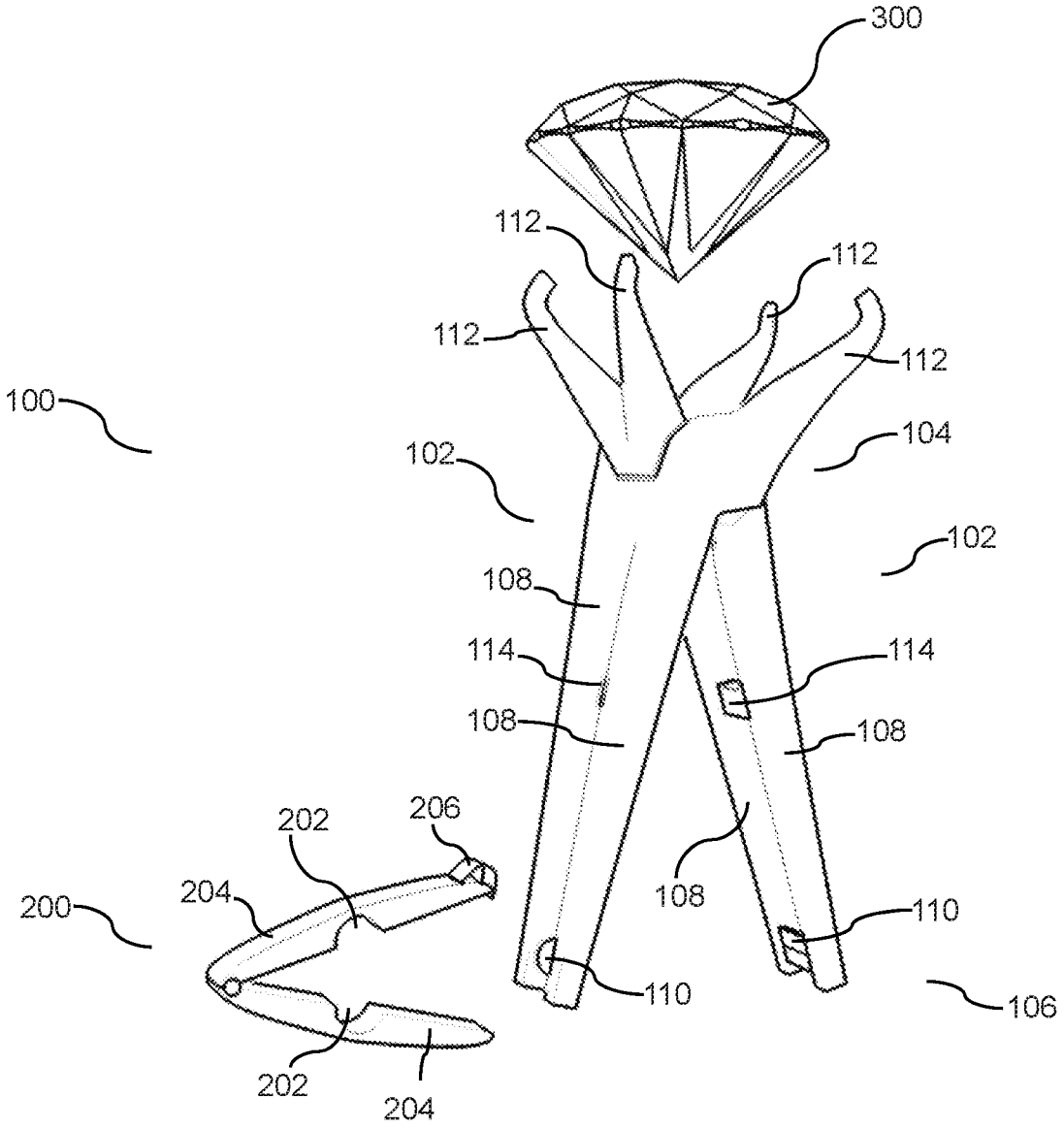
FIGS. 1A-1B provide perspective views of a cufflink with interchangeable setting in accordance with an embodiment of the invention.

In accordance with the figures and descriptions, embodiments of a cufflink with interchangeable setting where ornamental elements may be inserted, removed, and replaced are provided. With respect to the following detailed description, although the ornamental element is shown to be a gemstone, it will be understood that any ornamental element may be disposed on the interchangeable setting of the invention, such as, for example, a loose gem, a set gem, a plurality of gems, a plurality of set gems, a metallic engraving, an ornamental design element, a button, etc.

Turning to the drawings, FIGS. 1-4 show cufflinks with interchangeable setting (100) according to embodiments of the invention. As shown in these embodiments, the cufflink with interchangeable setting (100) includes a plurality of elongated shafts (102), a plurality of holding arms (112), and a securing mechanism (200). The plurality of elongated shafts (102) is rotatably interconnected about a single axis of rotation at a first end (104), and each shaft (102) is divided into at least two legs (108) at least at a second end (106) in accordance with exemplary embodiments. As shown in FIG. 1A, in such embodiments, a leg connecting part (110) is disposed between the legs (108) of each of the shafts (102) proximal to the second end (106) thereof. It will be understood in the art that this connecting part may take a variety of forms and thicknesses. As shown in FIGS. 1-5, the cufflink with interchangeable setting (100) has two elongated shafts (102) in some exemplary embodiments. In such embodiments, at least one elongated shaft (102) may further comprise at least one mechanical supporting part (114). Such additional mechanical support may provide reinforcement for better stability and durability. In still other embodiments, the elongated shafts (102) are divided into two legs (108).

As shown in FIGS. 1-4, according to embodiments of the invention, the plurality of holding arms (112) is disposed proximal to the first end (104) of the plurality of the elongated shafts (102) such that at least one holding arm (112) is disposed on each of the shafts (102). In such embodiments, when the elongated shafts (102) are rotated, the holding arms (112) rotate relative to each other. In other words, for embodiments of the invention, one can rotate the elongated shafts (102) to move the leg connecting parts (108) away from, or closer to, each other. By doing so, one can rotate the holding arms (112) closer to, or away from, each other, and in turn, one may easily choose to immobilize or remove an ornamental element (300) between the holding arms (112) of the interchangeable setting (100). In some exemplary embodiments, such as those represented in FIGS. 1-4, each elongated shaft (102) has two holding arms (112) disposed thereon. In still other embodiments, the elongated shafts (102) are rotatably interconnected by a hinge or pin.

According to embodiments of the invention, the interchangeable setting (100) has a secured position wherein the elongated shafts (102) are disposed parallel, and where the plurality of holding arms (112) are arranged to engage and immobilize an ornamental element (300) therebetween, and an open position wherein the elongated shafts (102) and holding arms (112) are rotated away from each other such that the ornamental element (300) is removable from the interchangeable setting (100). Such a secured position according to some exemplary embodiments is shown in FIGS. 1B and 2A-4. FIG. 1A displays an open position configuration according to such embodiments.

As shown in FIGS. 1-5, embodiments of the cufflink with interchangeable setting (100) include a securing mechanism (200). In such embodiments, the securing mechanism (200) is configured to releasably engage the leg connecting parts (110) of the elongated shafts (102) to prevent rotation of the shafts (102) relative to each other. In accordance with some embodiments, when the interchangeable setting (100) is configured to its secured position, the securing mechanism (200) is used to secure the setting (100), holding it in its secured position so that the leg connecting parts (110) do not rotate away from each other, and the ornamental element (300) thus remains immobilized by the holding arms (112) without falling out.

Figure 1B:
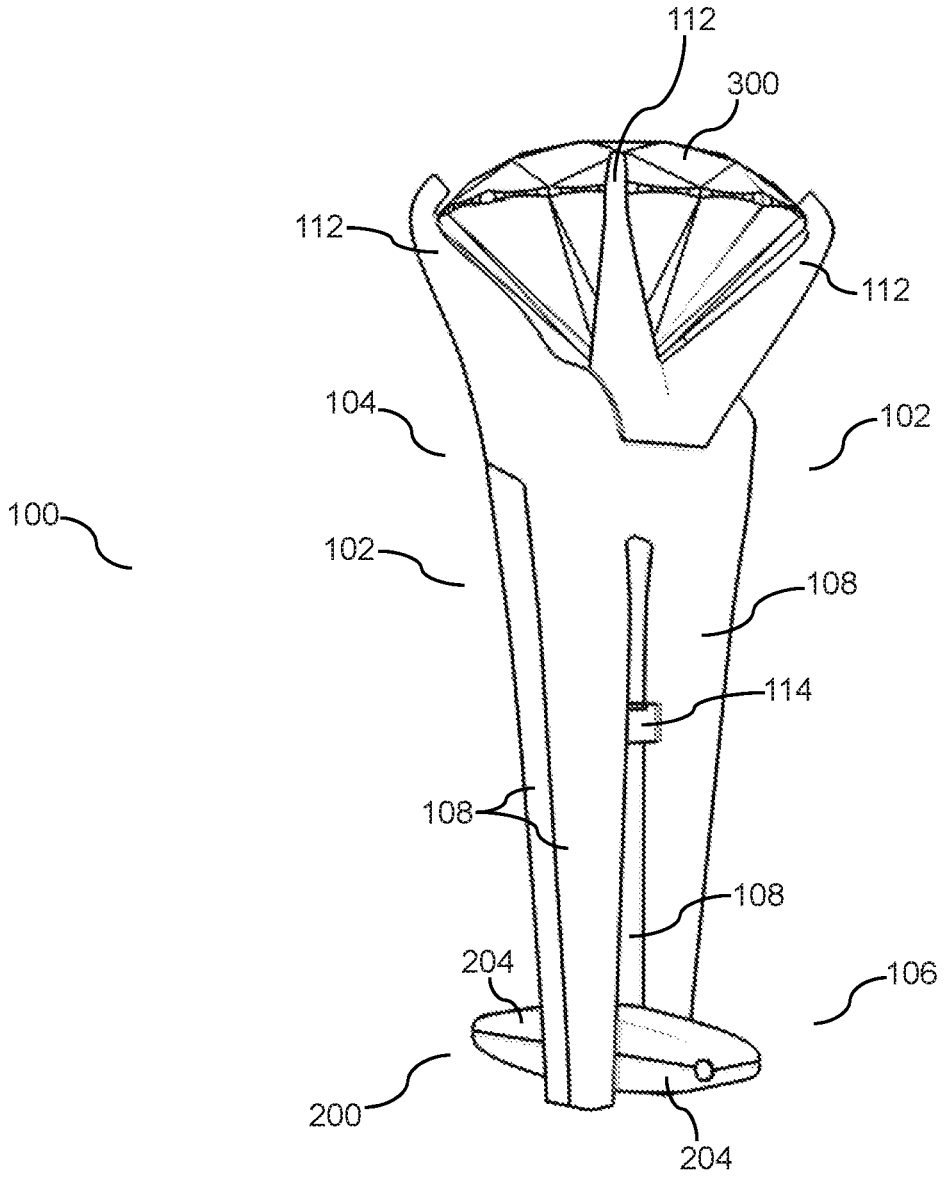
Figure 2A:
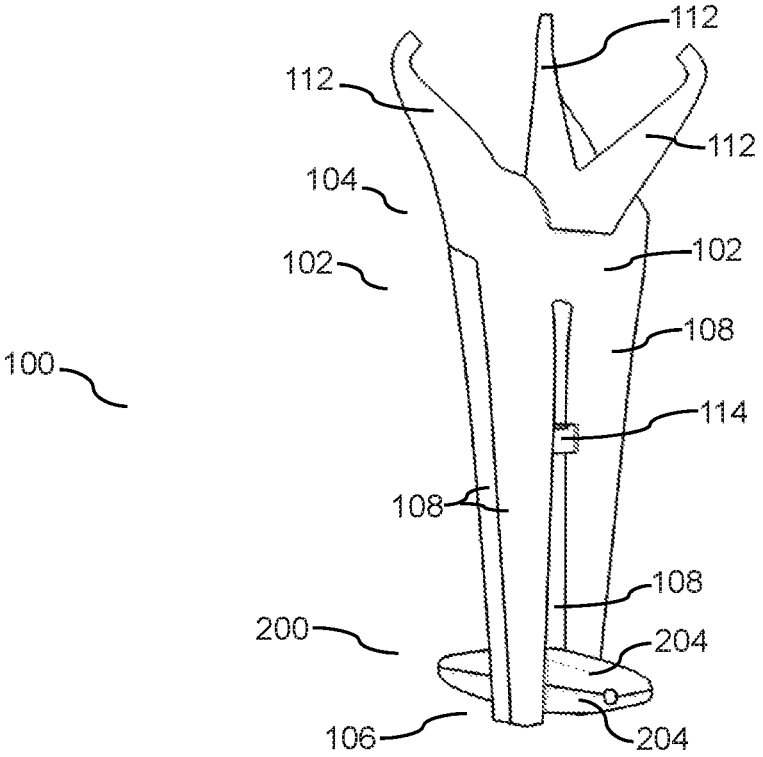
FIGS. 2A-2B provide perspective views of a cufflink with interchangeable setting in a secured position without an ornamental element in accordance with an embodiment of the invention.
Figure 2B:
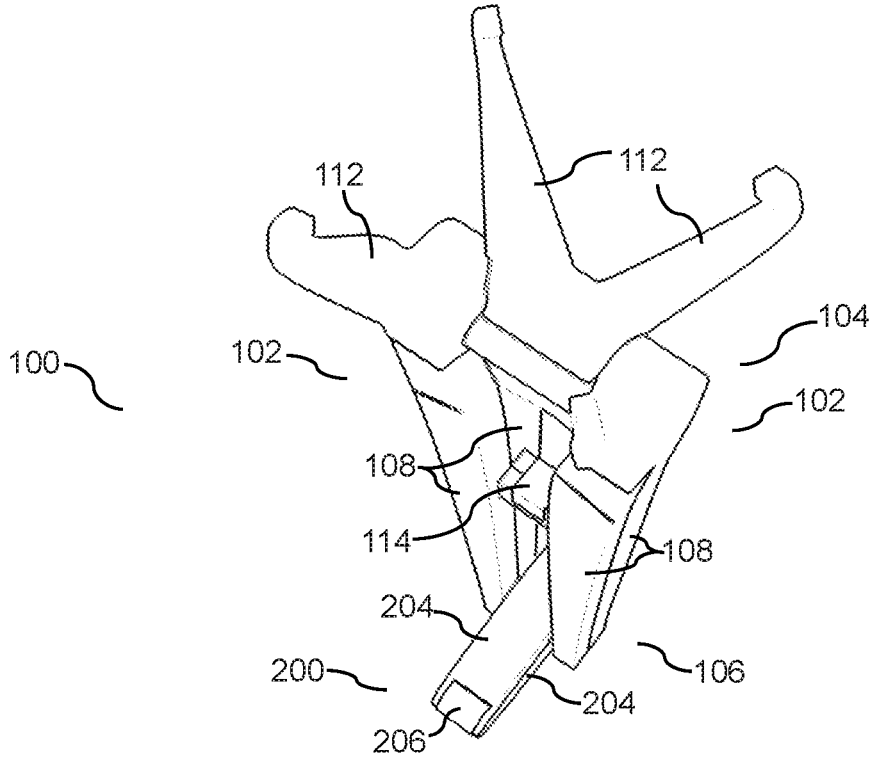
Figure 3A:
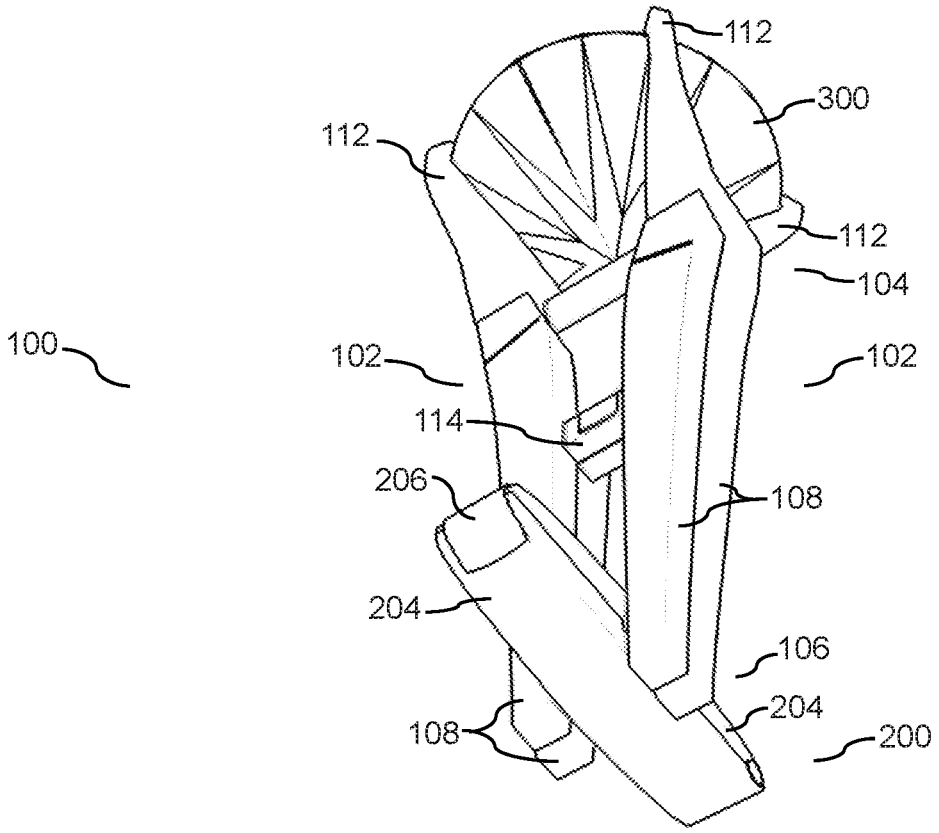
FIGS. 3A-3B provide perspective views of a cufflink with interchangeable setting in a secured position with an immobilized ornamental element in accordance with an embodiment of the invention.
Figure 3B:
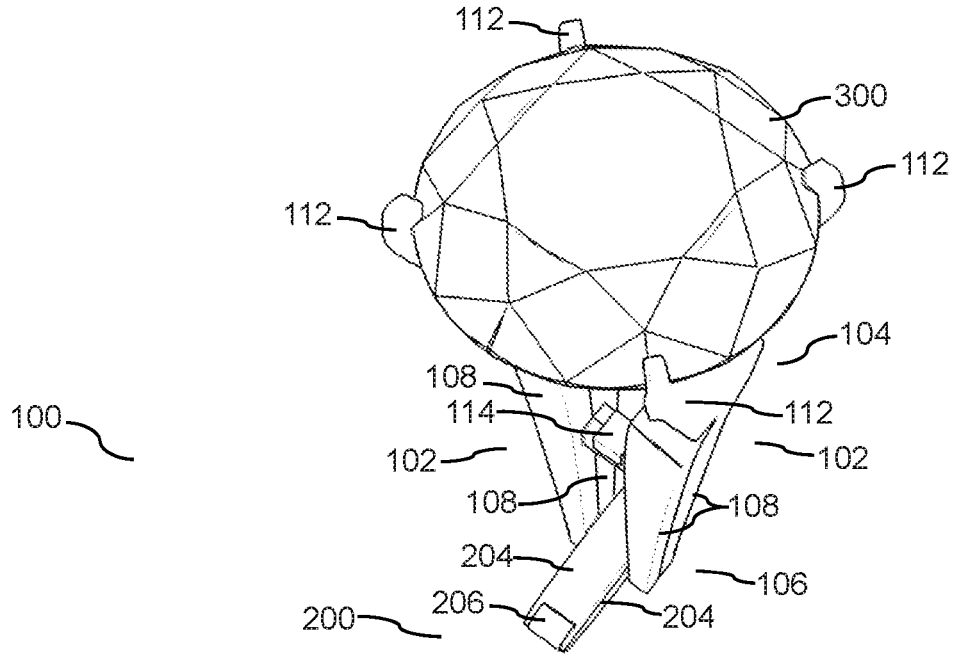
Figure 4:
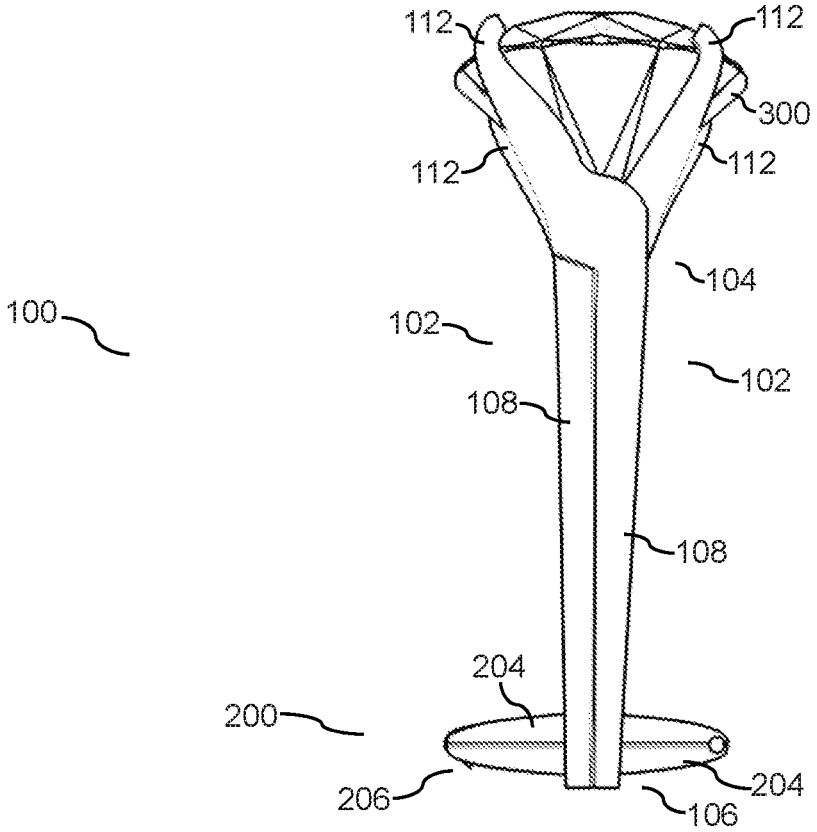
FIG. 4 provides a side view of a cufflink with interchangeable setting in a secured position with an immobilized ornamental element in accordance with an embodiment of the invention.

As represented in the drawings, according to some exemplary embodiments, the securing mechanism (200) is configured to rotate around the leg connecting parts (110) when the securing mechanism (200) engages the leg connecting parts (110) in the secured position. In such embodiments, the securing mechanism (200) has a parallel position where the securing mechanism (200) fits between the legs (108) and is disposed parallel to the elongated shafts (102). When the securing mechanism (200) is in this parallel position, the cufflink with interchangeable setting (100) may be inserted through cuff holes in a shirt. In these embodiments, the securing mechanism (200) also has a perpendicular position where the securing mechanism (200) is disposed perpendicular to the elongated shafts (102), as displayed in FIG. 4. FIGS. 1B and 2A also show the securing mechanism (200) in its perpendicular position. In such embodiments, when the securing mechanism (200) is rotated to its perpendicular position, the securing mechanism (200) will prevent the cufflink with interchangeable setting (100) from sliding out of the cuff holes, and the cufflink will be thus secured to the cuff of the shirt.

Figure 5:
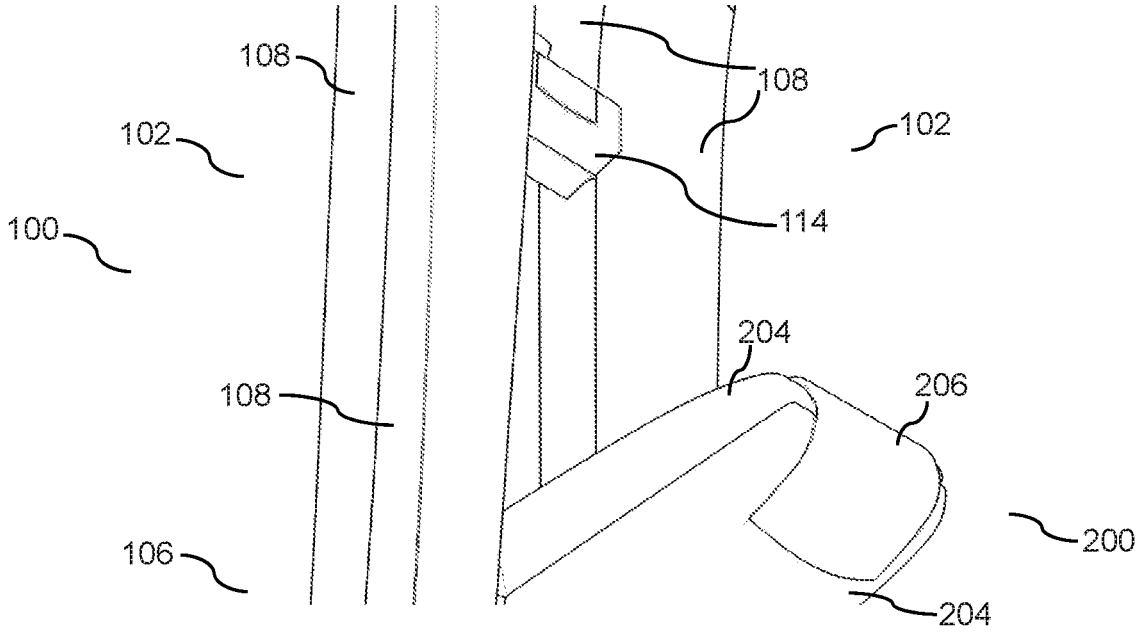
FIG. 5 provides a close-up view of the securing mechanism, legs, and mechanical supporting part in accordance with an embodiment of the invention.

According to some exemplary embodiments, the securing mechanism (200) comprises a plurality of securing arms (204), at least one groove (202), and a closure (206). In these embodiments, the plurality of securing arms (204) are rotatably interconnected about an axis of rotation, the at least one groove (202) is disposed to engage the leg connecting parts (110) therebetween, and the closure (206) is configured to releasably engage the securing arms (204) to prevent rotation of the securing arms (204). FIG. 1A presents an embodiment wherein each securing arm (204) has one groove (202) disposed thereon. FIGS. 1-5 also show the securing mechanism (200) having two securing arms (204) in accordance with some such exemplary embodiments. These embodiments also show that the securing arms (204) may be rotatably interconnected by a hinge or pin. In still other embodiments, the closure (206) may be selected from the group consisting of a clasp, latch, snap closure, slot closure, and magnetic closure. FIG. 5 offers a closer view of the securing mechanism (200) with respect to the legs (108) and an optional mechanical supporting part (114) in accordance with some embodiments of the invention.

In yet other embodiments, the leg connecting parts (110) may collectively form a cylindrical shape, having a circular cross section, in the secured position. Such a design may be preferred to facilitate rotation of the securing mechanism (200) around the leg connecting parts (110). In accordance with some such embodiments, each leg connecting part (110) may have a semicircular cross section. FIG. 1A shows leg connecting parts (110) with semicircular cross sections in accordance with some exemplary embodiments; the figure shows that the leg connecting parts (110) have a rounded outer surface and a flat inner surface, and that they may combine to produce a circular cross section. The leg connecting parts (110) of such embodiments would thus fit well within the similarly rounded grooves (202) of the securing mechanism (200) shown in FIG. 1A.

One exemplary embodiment of the cufflink with interchangeable setting (100) may have two elongated shafts (102) each being divided into two legs (108), a leg connecting part (110) having a semicircular cross section on each shaft (102), and two holding arms (112) disposed on each shaft (102). This exemplary embodiment may also have a securing mechanism (200) with two securing arms (204), two grooves (202), where each securing arm (204) has one groove (202) disposed thereon, and a closure (206). The leg connecting parts (110) may form a cylindrical shape in the secured position, each leg connecting part (110) having a semicircular cross section. Such an embodiment is shown in FIG. 1A.

As stated previously, though FIGS. 1A-1B, 3A-3B, and 4 display a loose gem for the ornamental element (300), it is understood in the art that other ornamental options may be used for the interchangeable setting (100). In some embodiments, the ornamental element (300) is selected from the group consisting of a loose gem, a set gem, a plurality of gems, a plurality of set gems, a metallic engraving, an ornamental design element, and a button.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the foregoing examples and descriptions of various preferred embodiments of the present invention are merely illustrative of the invention as a whole, and that variations in the components or steps of the present invention may be made within the spirit and scope of the invention. Accordingly, the present invention is not limited to the specific embodiments described herein, but, rather, is defined by the scope of the appended claims.

What is claimed is:

1. A cufflink with interchangeable setting comprising:

a plurality of elongated shafts, rotatably interconnected about a single axis of rotation at a first end, each shaft being divided into at least two legs at least at a second end thereof;

a leg connecting part disposed between the at least two legs of each of the shafts proximal to the second end thereof;

a plurality of holding arms disposed proximal to the first end of the plurality of elongated shafts such that at least one holding arm is disposed on each of the shafts, and such that the holding arms rotate relative to each other when the plurality of elongated shafts are rotated; and a securing mechanism, configured to releasably engage the leg connecting parts of the elongated shafts to prevent rotation of the shafts relative to each other;

wherein the interchangeable setting has a secured position wherein the elongated shafts are disposed parallel, and where the plurality of holding arms are arranged to engage and immobilize an ornamental element therebetween, and an open position wherein the elongated shafts and holding arms are rotated away from each other such that the ornamental element is removable from the interchangeable setting.

2. The cufflink with interchangeable setting of claim 1, wherein at least one elongated shaft further comprises at least one mechanical supporting part.

3. The cufflink with interchangeable setting of claim 1, wherein the elongated shafts are rotatably interconnected by a hinge or pin.

4. The cufflink with interchangeable setting of claim 1, wherein each elongated shaft has two holding arms disposed thereon.

5. The cufflink with interchangeable setting of claim 1, wherein each elongated shaft is divided into two legs at a second end thereof.

6. The cufflink with interchangeable setting of claim 1, wherein the cufflink with interchangeable setting has two elongated shafts.

7. The cufflink with interchangeable setting of claim 1, wherein the securing mechanism is configured to rotate around the leg connecting parts when the securing mechanism engages said leg connecting parts in the secured position, and wherein the securing mechanism has a parallel position where the securing mechanism is disposed parallel to the elongated shafts, and a perpendicular position where the securing mechanism is disposed perpendicular to the elongated shafts.

8. The cufflink with interchangeable setting of claim 7, wherein the securing mechanism comprises:

a plurality of securing arms, where the plurality of securing arms are rotatably interconnected about an axis of rotation;

at least one groove, where the at least one groove is disposed to engage the leg connecting parts therebetween; and a closure, where the closure is configured to releasably engage the securing arms to prevent rotation of the securing arms.

9. The cufflink with interchangeable setting of claim 8, wherein each securing arm has one groove disposed thereon.

10. The cufflink with interchangeable setting of claim 8, wherein the securing mechanism has two securing arms.

11. The cufflink with interchangeable setting of claim 8, wherein the closure is selected from the group consisting of a clasp, latch, snap closure, slot closure, and magnetic closure.

12. The cufflink with interchangeable setting of claim 8, wherein the securing arms are rotatably interconnected by a hinge or pin.

13. The cufflink with interchangeable setting of claim 1, wherein the leg connecting parts collectively form a cylindrical shape in the secured position.

14. The cufflink with interchangeable setting of claim 13, wherein each leg connecting part has a semicircular cross section.

15. The cufflink with interchangeable setting of claim 1, wherein the ornamental element is selected from the group consisting of a loose gem, a set gem, a plurality of gems, a plurality of set gems, a metallic engraving, an ornamental design element, and a button.

16. A cufflink with interchangeable setting comprising:

two elongated shafts, rotatably interconnected about a single axis of rotation at a first end, each shaft being divided into two legs at least at a second end thereof;

a leg connecting part disposed between the at least two legs of each of the shafts proximal to the second end thereof;

a plurality of holding arms disposed proximal to the first end of the two elongated shafts such that two holding arms are disposed on each of the shafts, and such that the holding arms rotate relative to each other when the two elongated shafts are rotated; and a securing mechanism, configured to releasably engage the leg connecting parts of the elongated shafts to prevent rotation of the shafts relative to each other, where the securing mechanism comprises:

two securing arms, where the securing arms are rotatably interconnected about an axis of rotation;

two grooves, where the grooves are disposed to engage the leg connecting parts therebetween, and where each securing arm has one groove disposed thereon; and a closure, where the closure is configured to releasably engage the securing arms to prevent rotation of the securing arms;

wherein the interchangeable setting has a secured position wherein the elongated shafts are disposed parallel, and where the plurality of holding arms are arranged to engage and immobilize an ornamental element therebetween, and an open position wherein the elongated shafts and holding arms are rotated away from each other such that the ornamental element is removable from the interchangeable setting;

wherein the securing mechanism is configured to rotate around the leg connecting parts when the securing mechanism engages said leg connecting parts in the secured position, and wherein the securing mechanism has a parallel position where the securing mechanism is disposed parallel to the elongated shafts, and a perpendicular position wherein the securing mechanism is disposed perpendicular to the elongated shafts; and wherein the leg connecting parts collectively form a cylindrical shape in the secured position, and each leg connecting part has a semicircular cross section.

17. The cufflink with interchangeable setting of claim 16, wherein at least one elongated shaft further comprises at least one mechanical supporting part.

18. The cufflink with interchangeable setting of claim 16, wherein the elongated shafts are rotatably interconnected by a hinge or pin.

19. The cufflink with interchangeable setting of claim 16, wherein the closure is selected from the group consisting of a clasp, latch, snap closure, slot closure, and magnetic closure.

20. The cufflink with interchangeable setting of claim 16, wherein the ornamental element is selected from the group consisting of a loose gem, a set gem, a plurality of gems, a plurality of set gems, a metallic engraving, an ornamental design element, and a button.

21. The cufflink with interchangeable setting of claim 16, wherein the securing arms are rotatably interconnected by a hinge or pin.

* * * * *